United States Patent [19]

Kusayama

[11] Patent Number: 4,780,937

[45] Date of Patent: Nov. 1, 1988

[54] FLUID-TIGHT SLIDE FASTENER

[75] Inventor: Masahiro Kusayama, Kurobe, Japan

[73] Assignee: Yoshida Kogyo K.K., Tokyo, Japan

[21] Appl. No.: 150,506

[22] Filed: Feb. 1, 1988

Related U.S. Application Data

[63] Continuation of Ser. No. 46,431, May 6, 1987.

[30] Foreign Application Priority Data

May 6, 1986 [JP] Japan ..... 61-68058[U]

[51] Int. Cl.[4] ..... A44B 19/32

[52] U.S. Cl. ..... 24/389; 24/381

[58] Field of Search ..... 24/389, 384, 381, 419, 24/433, 436

[56] References Cited

U.S. PATENT DOCUMENTS

| | | | |
|---|---|---|---|
| 2,515,376 | 7/1950 | Krupp | 24/389 |
| 2,535,391 | 12/1950 | Clarke | 24/389 |
| 2,557,827 | 6/1951 | Krupp | 24/389 |
| 2,800,699 | 7/1957 | Armstrong | 24/389 |
| 3,685,103 | 8/1972 | Severino | 24/381 |
| 3,864,792 | 2/1975 | Takahashi et al. . | |
| 3,869,765 | 3/1975 | Fukuroi . | |
| 3,959,858 | 6/1976 | Fukuroi . | |
| 4,488,338 | 12/1984 | Takahashi . | |
| 4,513,482 | 4/1985 | Fukuroi . | |
| 4,524,493 | 6/1985 | Inamura | 24/389 |
| 4,658,480 | 4/1987 | Morioka et al. . | |

FOREIGN PATENT DOCUMENTS

| | | | |
|---|---|---|---|
| 359296 | 1/1958 | Japan . | |
| 58-181210 | 12/1983 | Japan . | |
| 58-181211 | 12/1983 | Japan . | |
| 59-93208 | 6/1984 | Japan . | |
| 59-93209 | 6/1984 | Japan . | |
| 59-51805 | 12/1984 | Japan . | |
| 1201290 | 8/1970 | United Kingdom | 24/389 |

*Primary Examiner*—Victor N. Sakran

*Attorney, Agent, or Firm*—Hill, Van Santen, Steadman & Simpson

[57] ABSTRACT

A fluid-tight slide fastener comprises a pair of stringers each having a water-proof support tape and a row of coupling elements mounted on and along a bent inner longitudinal edge of the support tape, a slider slidably mounted on the two rows of coupling elements to take the latter into and out of coupling engagement with each other to close and open the slide fastener, and a top end stop mounted on upper ends of the support tapes and having embedded therein a length of the folded edges. The bent inner longitudinal edge has throughout the length thereof a pair of upper and lower sealing abutments disposed on opposite sides of an intermediate portion folded around the row of coupling elements. The upper sealing abutments are spaced from one another by a first distance substantially equal to the width of a diamond of the slider while the lower sealing abutments are spaced from one another by a second distance smaller than the width of the slider diamond. With these spacings between the sealing abutments, the slider is allowed to move in the fastener closing direction to assure full closure of the slide fastener without affecting the fluid-tight property of the slide fastener.

6 Claims, 3 Drawing Sheets

FLUID-TIGHT SLIDE FASTENER

This is a continuation of application Ser. No. 046,431 filed May 6, 1987.

BACKGROUND OF THE INVENTION

1. Field of the Invention

This invention relates generally to slide fasteners and more particularly to such slide fasteners as are suitable for fluid-tight applications.

2. Description of the Prior Art

There have been proposed numerous types of fluid-tight slide fasteners for use on for example diving suits, water rescue equipment and other articles requiring hermetic seal against fluid leakage.

A typical known fluid-tight slide fastener is disclosed in Japanese Patent Publication No. 35-9296, published July 15, 1960. The disclosed slide fastener comprises a pair of stringers each having a water-proof support tape and a row of coupling elements mounted on one longitudinal edge of the tape, the stringers being coupled and uncoupled by a slider. To establish fluid-tightness of the slide fastener, the longitudinal edge of the support tape is bent perpendicularly to the general plane of the slide fastener and includes an intermediate portion folded around the row of elements. The thus folded tape edge is externally enveloped by a row of sealing clamps positioned in registry with the corresponding individual coupling elements. The fastener stringers are joined together at their upper ends where a top end stop is disposed to limit movement of the slider. The slide fastener further includes a backing sheet adhered to the underside of the upper end portions of the support tapes. The backing sheet includes a tapered sealing projection projecting into a space between the bent longitudinal tape edges, the projection being spaced a distance from the top end stop. As the slider is moved toward the top end stop to close the slide fastener, the two rows of coupling elements are progressively coupled together and the bent longitudinal edges are brought into sealing engagement with each other. When the slide fastener is fully closed, several coupling elements, which are disposed between the top end stop and the sealing projection, are left uncoupled. However, the sealing projection is held in sealing contact with a lower sealing abutment of each bent longitudinal tape edge so that the slide fastener is kept water-tight as a whole.

The known slide fastener of the foregoing construction has the following disadvantages: As the bent longitudinal edges of the opposed support tapes are parallel spaced from one another by a distance smaller than the width of a wedge or diamond of the slider, a muscle effort is required to move the slider to its uppermost position against the frictional resistance acting between the longitudinal tape edges and the slider diamond. The lower sealing abutments of the longitudinal tape edges are spread by the sealing projection. When the slider passes over the sealing projection, the thus spread tape edge portions are brought into severe frictional engagement with opposite side flanges of the slider. Due to this undue friction, the slider is likely to stop ahead of the top end stop and hence it is not possible to fully close the slide fastener. These difficulties have been confirmed through an experiment which was carried out in respect of the slide fasteners made in accordance with the above-mentioned Japanese publication and available in the market.

SUMMARY OF THE INVENTION

With the foregoing difficulties in view, the present invention seeks to provide a fluid-tight slide fastener having structural features which allow smooth sliding movement of the slider in the fastener closing direction to assure full closure of the slide fastener without affecting the fluid-tight property of the slide fastener.

According to the present invention, the foregoing and other objects are attained by a fluid-tight slide fastener which comprises: a pair of stringers each having a water-proof support tape and a row of coupling elements mounted on and along a bent inner longitudinal edge of the support tape, the bent inner longitudinal edge having throughout the length thereof an intermediate portion folded around the row of coupling elements and a pair of upper and lower sealing abutments disposed on opposite sides of the intermediate folded portion; a slider slidably mounted on the two rows of coupling elements to take the latter into and out of coupling engagement with each other to close and open the slide fastener; and a top end stop mounted on upper ends of the support tapes and having embedded therein a length of the folded edges, the upper sealing abutments on the support tapes being spaced from one another by a first distance which is substantially equal to the width of a diamond of the slider, the lower sealing abutments on said support tapes being spaced from one another by a second distance which is smaller than the width of the slider diamond.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
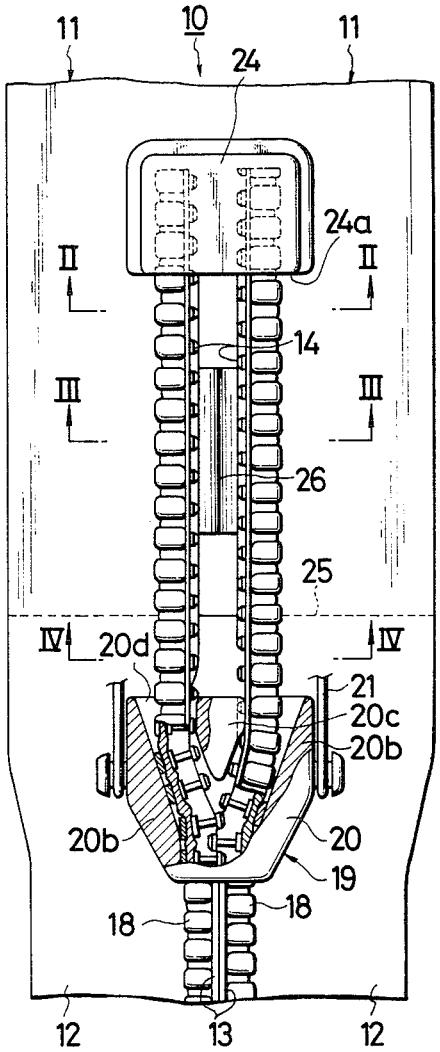
FIG. 1 is a fragmentary front elevational view, partly in cross section, of a fluid-tight slide fastener according to the present invention.
Figure 2:
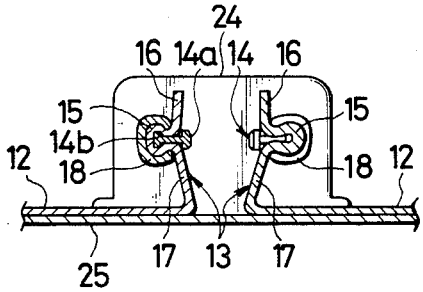
FIG. 2 is an enlarged cross-sectional view taken along line II—II of FIG. 1.

Referring now to FIG. 1, there is shown a fluid-tight slide fastener 10 embodying the present invention, the fastener 10 comprising a pair of stringers 11 each including a support tape 12 coated with rubber or other impermeable material and carrying on and along its inner longitudinal edge 13 a row of coupling elements 14 which is presently illustrated to be of a discrete formation contrastive to a continuous formation. As shown in FIG. 2, each of the individual coupling element 14 has a coupling head portion 14*a* engageable with the corresponding coupling head portion 14*a* on the mating or opposite support tape 12 and a heel portion 14*b* disposed remote from the coupling head portion 14*a*. The tape edge 13 is bent upwardly at an angle to the general plane of the slide fastener and includes an intermediate longitudinal portion folded as at 15 around the heel portion 14*b* and enveloping the major portion of the coupling element 14. The tape edge 13 thus folded has a generally horizontal Ω shape and defines a longitudinal groove in which the coupling elements 14 are received. Disposed on opposite sides of the folded portion 15 are upper and lower sealing abutments 16 and 17, respectively, which are brought into sealing contact with the upper and lower sealing abutments 16, 17 of the opposite support tape 12 so as to provide a hermetic seal against leakage between the fastener stringers 11. Designated at 18 are sealing clamps positioned in registry with corresponding coupling elements 14 and clinched around the folded edge portion 15 of the tape 12 to firmly retain the coupling elements 14 in position in a manner well known in the art. The slider 19 is conventional in that it has a slider body 20 and a pull tab 21 with which to manipulate the slider 19.

Figure 3:
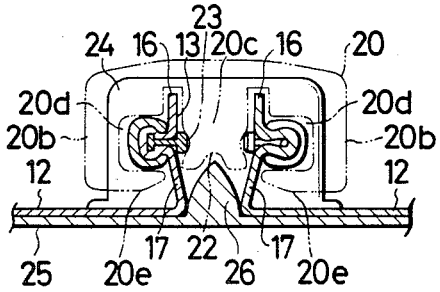
FIG. 3 is an enlarged cross-sectional view taken along line III—III of FIG. 1.
Figure 4:
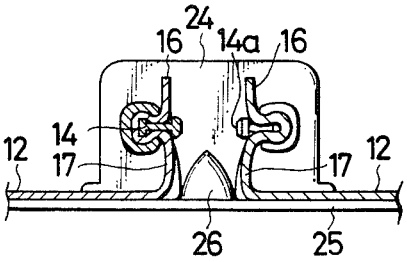
FIG. 4 is an enlarged cross-sectional view taken along line IV—IV of FIG. 1.

The slider body 20 includes, as shown in FIGS. 1 and 3, an upper plate 20*a*, a pair of side walls 20*b* extending along opposite longitudinal edges of the upper plate 20 *a*, and a partition wall or diamond 20*c* disposed centrally between the side walls 20*b* depending from the upper plate 20*a*, being defined in the slider body 20 a generally Y-shaped guide channel 20*d* for the passage therethrough of the opposed rows of coupling elements 14 to come into or out of engagement with each other. The side walls 20*b* respective flanges 20*e*, 20*e* directed inwardly toward each other and receivable in a pair of clearances defined between the folded portions 15 of the respective tape edges 13 and the flat webs of the support tapes 11. The diamond 20*c* disposed at the forward end of the slider body 20 and includes, as shown in FIG. 3, a longitudinal guide groove 22 facing downwardly away from the upper plate 20*a* for a purpose described below, and a pair of lateral guide recesses 23 guidingly engageable with the coupling heads 14*a* of the coupling elements 14. The movement of the slider 19 is limited or stopped at the top end of the stringer 11 by a top end stop 24 which may be applied for example by injection molding to the stringers 11 across the support tapes 12. The top end stop 24 has a vertical end wall 24*a* engageable with the slider 19.

There is provided a backing sheet 25 which is adhered to the lower surface of the top end portions of the support tapes 12 to reinforce the latter. The backing sheet 25 is made preferably of synthetic rubber and includes a sealing projection 26 extending longitudinally of the slide fastener 10 over a length of the rows of coupling coupling elements 14 and projecting into a space between the opposed bent tape edges 13. The sealing projection 26 has a generally triangular cross-sectional shape which is complementary to the shape of the guide groove 22 in the slider diamond 20*c*. As shown in FIG. 1, the sealing projection 26 is spaced from the end wall 24*a* of the top end stop 24 by a distance which is slightly larger than the length of the diamond 20*c* of the slider 19. In the illustrated embodiment, this distance is substantially three times the element pitch or inter-element distance.

The top end stop 24 is substantially in the form of a rectangular block which is made preferably of a thermoplastic resin for its feasibility of being molded into a desired shape and for its flexibility of yielding to pressures exerted by the slider 19. The top end stop 24 contains or has embedded therein a portion of bent edge 13 of each tape 12 including a plurality of coupling elements 14. The tape edges 13 are retained such that the upper sealing abutments 16 of the bent tape edges 13 extend perpendicularly to the general plane of the slide fastener 10 and are parallel spaced from one another by a distance which is substantially equal to, perferably slightly larger than, the width of the diamond 20*d* of the slider 19 while the lower sealing abutments 17 of the tape edges 13 are spaced from one another by a distance which is smaller than the width of the slider diamond 20*d* but preferably is substantially equal to the width of the sealing projection 26. As shown in FIG. 2, the lower sealing abutments 17 are downwardly converged toward each other in such a manner that the maximum spacing and the minimum spacing between the lower sealing abutments 17 are corresponding respectively to the width of the slider diamond 20*d* and the width of the sealing projection 26.

Figure 5:
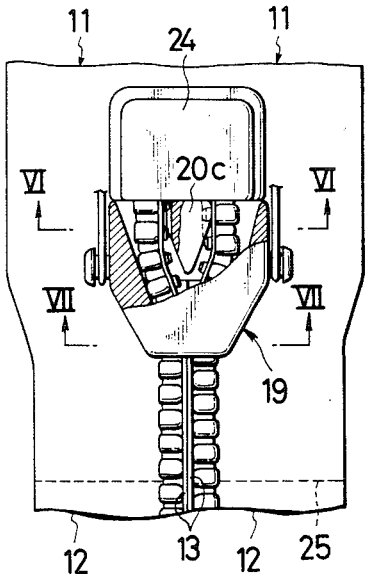
FIG. 5 is a view similar to FIG. 1, but showing the slide fastener as it is fully closed.
Figure 6:
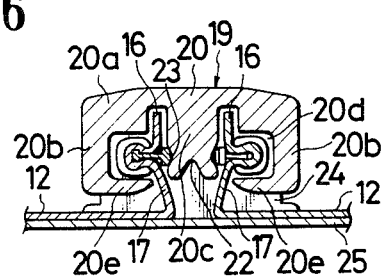
FIG. 6 an enlarged cross-sectional view taken along line VI—VI of FIG. 5.
Figure 7:
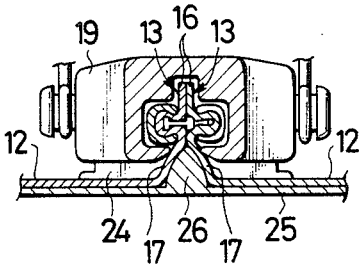
FIG. 7 is an enlarged cross-sectional view taken along line VII—III of FIG. 5.

In use, the slider 19 is moved toward and away from the top end stop 24 to close and open the slide fastener 10. As the slider 19 moves toward the top end stop 24, the coupling heads 14*a* of the two rows of coupling elements 14 are guided in and along the guide recesses 23 in the slider diamond 20*c* and then they are brought into interdigitating engagement with each other. At the same time, the upper and lower sealing abutments 16, 17 of the opposed bent tape edges 13 are brought into sealing engagement with each other to provide a hermetic seal between the fastener stringers 11. Due to the flexibility of the stringers 11, the bent tape edges 13 flex to follow the profile of the slider diamond 20*c*, thereby allowing smooth sliding movement of the slider 19 at least until the slider 19 arrives at the reinforced upper ends of the stringers 11 where the sealing projection 26 is disposed. A further movement of the slider 19 in the fastener closing direction causes the slider 19 to move over and along the sealing projection 26 in which instance the lower sealing abutments 17 of the bent tape edges 13 are forced into sealing engagement with the sealing projection 26, and at the same time the upper sealing abutments 16 are progressively brought into sealing engagement with each other, as shown in FIG. 7. During that time, smooth movement of the slider 19 is not affected because the sealing projection 26, which has the width substantially equal to the minimum space between the lower sealing abutments 17, does not spread the bent tape edges 13 widthwise into frictional engagement with the flanges 20*e* of the slider 19, as shown in FIG. 3. In combination with this spacing between the lower sealing abutments 17, the spacing between the upper sealing abutments 16 (which is substantially equal to the width of the slider diamond 20*c*) ensures that the slider 19 can smoothly brought into abutment with the vertical end wall 24*a* of the top end stop 24. When the slide fastener 10 is fully closed as shown in FIG. 5, several uppermost coupling elements are left uncoupled because the slider diamond 20*c* is interposed between the top end stop 24 and the sealing projection 26. However, as shown in FIG. 7, there is provided a hermetic seal in the slider 19 by and between the upper sealing abutments 16 on one hand, and between the lower sealing abutments 17 and the sealing projection 26, on the other hand, the slide fastener 10 is kept water-tight as a whole. It appears from the foregoing description that the slider 19 is allowed to move smoothly toward the top end stop 24 to fully close the slide fastener 10 without affecting the sealing property of the slide fastener 10.

Figure 8:
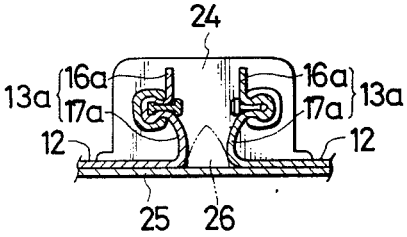
FIG. 8 is a view similar to FIG. 2, showing a modification of the present invention.

FIG. 8 shows a modification of the present invention wherein a bent longitudinal edge 13*a* of each support tape 12 has an upper sealing abutment 16*a* extending perpendicular to the general plane of the slide fastener, and a curved lower sealing abutment 17*a*. The spacing between the opposed upper sealing abutments 16*a* and the spacing between the opposed lower sealing abutments 17*a* are the same as the spacings described with respect to the first embodiment shown in FIGS. 1 through 7.

Obviously, many modifications and variations of the present invention are possible in the light of the above teachings. It is therefore to be understood that within the scope of the appended claims, the invention may be practiced otherwise than as specifically described.

What is claimed is:

1. A fluid-tight slide fastener comprising:

(a) a pair of stringers each having a water-proof support tape and a row of coupling elements mounted on and along a bent inner longitudinal edge of said support tape, said bent inner longitudinal edge having throughout the length thereof an intermediate portion folded around said row of coupling elements and a pair of upper and lower sealing abutments disposed on opposite sides of said intermediate folded portion;

(b) a slider slidably mounted on the two rows of coupling elements to take the latter into and out of coupling engagement with each other to close and open the slide fastener;

(c) a top end stop mounted on upper ends of said support tapes and having embedded therein a length of said folded edges, said upper sealing abutments on said support tapes being spaced from one another within said top end stop by a first distance which is substantially equal to the width of a diamond of said slider, said lower sealing abutments on said support tapes being spaced from one another within said top end stop by a minimum second distance which is smaller than the width of said slider diamond; and (d) a backing sheet attached to the underside of said upper ends of said support tapes and having a sealing projection extending longitudinally of said support tapes and projection extending longitudinally of said support tapes and projecting between said bent inner longitudinal edges, said sealing projection being spaced from said top end stop by a third distance which is slightly larger than the length of said slider diamond, said sealing projection having a width substantially equal to said distance.

2. A fluid-tight slide fastener according to claim 1, said first distance being slightly larger than the width of said slider diamond.

3. A fluid-tight slide fastener according to claim 1, said lower sealing abutments being inclined at an angle to a general plane of the slide fastener and converging downwardly away from said upper sealing abutments.

4. A fluid-tight slide fastener according to claim 1, said lower sealing abutments being arcuate and converging downwardly away from said upper sealing abutments.

5. A fluid-tight slide fastener according to claim 1, said upper sealing abutments extending perpendicular to a general plane of the slide fastener, said lower sealing abutments being inclined at an angle to the general plane of the slide fastener and converging downwardly away from said upper sealing abutments.

6. A fluid-tight slide fastener according to claim 1, said upper sealing abutments extending perpendicular to a general plane of the slide fastener, said lower sealing abutments being arcuate and converging downwardly away from said upper sealing abutments.

* * * * *